United States Patent [19]

White

[11] 4,186,853

[45] Feb. 5, 1980

[54] CONTINUOUS AEROSOL DEVICE

[75] Inventor: Barry F. White, Merrimack, N.H.

[73] Assignee: Summit Packaging Systems, Inc., Manchester, N.H.

[21] Appl. No.: 5,484

[22] Filed: Jan. 22, 1979

[51] Int. Cl.[2] ..... B65D 83/14

[52] U.S. Cl. ..... 222/182; 222/402.14; 251/90

[58] Field of Search ..... 222/153, 182, 402.1, 222/402.13, 402.14, 541; 239/288.5, 359, 573; 251/89, 90, 111; 137/797

[56] References Cited

U.S. PATENT DOCUMENTS

| | | | |
|---|---|---|---|
| 3,107,827 | 10/1963 | Burmeister | 251/90 X |
| 3,223,287 | 12/1965 | Sagarin | 222/402.13 X |
| 3,325,064 | 6/1967 | Sheck | 222/402.14 |
| 3,765,573 | 10/1973 | Landsman | 222/402.14 X |
| 3,804,302 | 4/1974 | Yamada et al. | 222/402.14 X |
| 3,920,162 | 7/1974 | Kimura | 222/402.14 X |

*Primary Examiner*—Stanley H. Tollberg
*Assistant Examiner*—Fred A. Silverberg
*Attorney, Agent, or Firm*—Dallett Hoopes

[57] ABSTRACT

Aerosol includes overcap having a shoulder thereinside spaced downward from the top of the overcap and a washer-like element in the top wall of the overcap which may be broken away and placed up under the overcap against the shoulder so that when the overcap is reinstalled on the container, the washer-like element presses down an upwardly directed actuator provided on the container.

7 Claims, 5 Drawing Figures

CONTINUOUS AEROSOL DEVICE

BACKGROUND OF THE INVENTION

1. Field of the Invention

This invention relates to aerosol devices wherein means are provided to continuously dispense the aerosol contents until the container is exhausted.

2. Description of the Prior Art

In the prior art, there are devices useful for continuously dispensing aerosol. An example is shown in the Landsman U.S. Pat. No. 3,765,573, which issued Oct. 16, 1973. In this device, an overcap is provided which may be opened then inverted and reinstalled on the can to hold the conventional aerosol stem in discharged condition. Another aerosol hold-down device is disclosed in U.S. Pat. No. 3,325,064, which issued June 13, 1967 and which covers a sleeve-like device which fits over the aerosol actuator and engages the valve pedestal. Other art includes a hold-down device not useful as a dispensing assistant but merely to hold the valve on after the can is used to assure that the can's residual product will not cause an explosion when the can is incinerated. Such a device is shown in the Yamada et al patent U.S. Pat. No. 3,804,302, which issued Apr. 16, 1974.

SUMMARY OF THE INVENTION

Under the present invention, an overcap-like device snaps onto the aerosol can over a conventional upward dispensing button. The overcap has a central aperture surrounded by a concentric line of perforations. In use, the washer-like element defined by the perforations is broken away by the user to leave a large opening, the overcap removed from the container, and the washer-like element installed up in the underside of the overcap so that when the overcap is reinstalled, the washer-like element engages the aerosol actuator to depress it, permitting it to discharge through the large opening thus formed in the top of the overcap.

BRIEF DESCRIPTION OF THE DRAWINGS

Further objects and features of the invention will be apparent from a study of the following specification, including the drawings, all of which disclose a non-limiting form of the invention. In the drawings:

FIG. 5 is a view similar to FIG. 1 but showing the washer-like element in use to hold the aerosol dispenser continuously on.

DESCRIPTION OF THE PREFERRED EMBODIMENT

Figure 1:
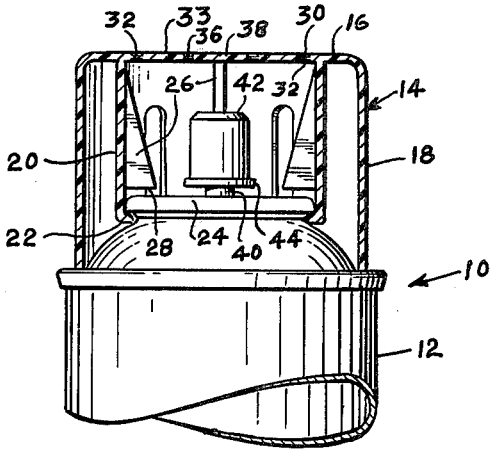
FIG. 1 is a sectional view of an overcap embodying the invention shown installed on an aerosol can which is partly broken away to conserve drawing space.

An aerosol dispenser, including an overcap embodying the invention, is generally designated 10 in FIG. 1. It comprises a container 12 and the overcap 14.

As shown, the overcap comprises a generally inverted cup-shaped structure having a top wall 16 and a depending continuous sidewall 18. Inward from the sidewall are more or less conventional legs 20 which extend down from the top wall 16 and carry at their lower end nibs 22 which snap into engagement under the aerosol mounting cup flange 24. As shown (FIGS. 1, 2), the legs are formed with a plurality of inward tapering ribs 26 which enlarge as their downward end is approached to present downwardly facing shoulder means 28 spaced just above the mounting cup flange The upper wall of the overcap is formed with preferably a circular line of perforations or slots 30 concentric with the axis of the overcap. These perforations leave bridges 32 between a central annular or washer-like portion 33 of the overcap and the surrounding structure (FIG. 1). Central of the overcap is an inner line of perforations 34 also concentric and also defining an area which is joined to the surrounding area by bridges 36.

Figure 2:
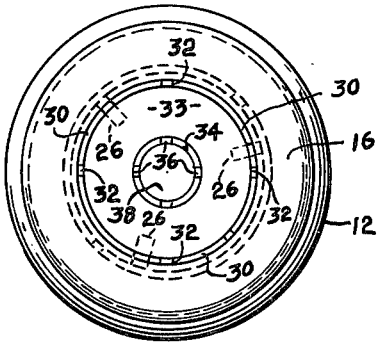
FIG. 2 is a top plan view of the overcap.
Figure 3:
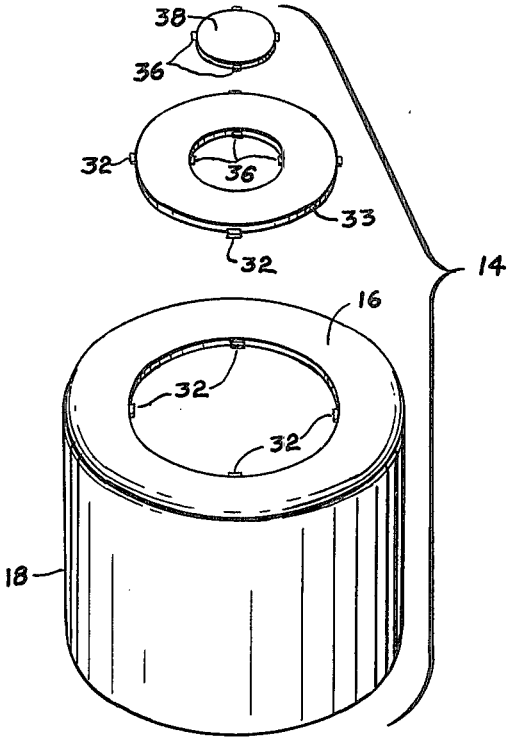
FIG. 3 is an exploded perspective, slightly enlarged, view of the overcap with the washer-like element broken away.

While it is preferred to have this inner line of perforations 34, an alternate embodiment simply provides an opening which, in the FIG. 2 version, eliminates the central disc 38 and provides a central aperture, as will be understood.

Normally, the overcap of the invention is made from polypropylene or other relatively stiff, yet yielding, plastic substance as has been the practice in the past.

As is conventional, the container 12 is provided wih a tubular stem 40, the depression of which actuates an inner aerosol valve (not shown). Fitting snugly on the stem 40 is the actuator button 42 with its upward dispensing orifice. The button 42 is formed with an outward lower flange 44.

The structure of the invention has been described. Its use will now be readily understood. The unit is produced and shipped to the retailer with the aerosol cap in place as shown in FIG. 1. Both the central disc 38 and the washer-like element 33 are in place giving the unit, except for the lines of perforations 30 and 34, visibility only on close inspection. The overcap 14 has the appearance of a conventional overcap. When the customer buys the product and wishes to use it, he merely removes the overcap 14 in the conventional manner and breaks away the portion of the top within the perforations 30 to thereby leave a central opening in the overcap. This is done by merely poking one's finger up through the bottom of the overcap and forcibly breaking the bridges 32.

In embodiments including the central disc 38, the user breaks away and discards such disc by forcibly rupturing the bridges 36 in the line of perforations 34.

Figure 4:
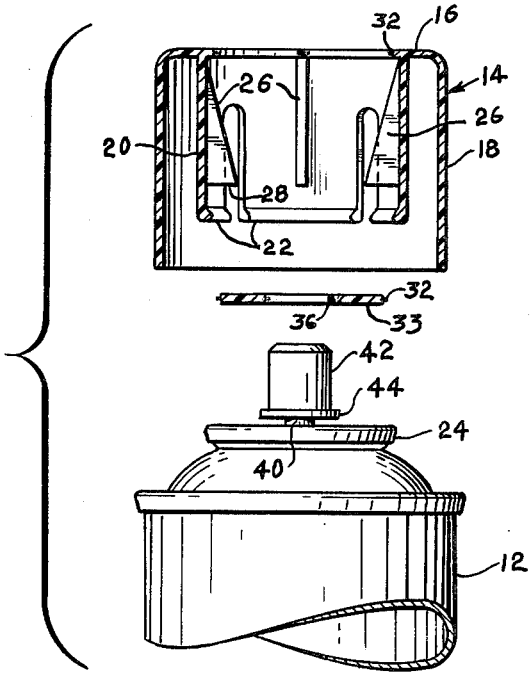
FIG. 4 is a sectional view of the overcap similar to FIG. 1 but showing the rearrangement of parts as the unit is being adapted for continuous spray use.
Figure 5:
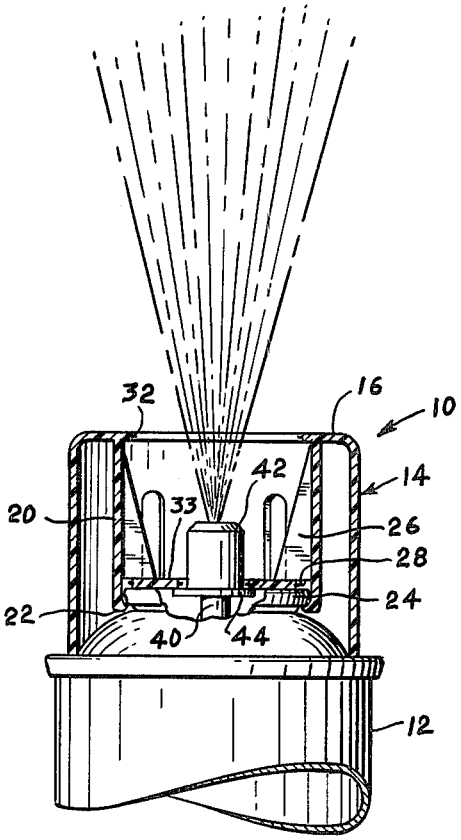

The washer-like element 33, now separate from the overcap, is then placed up under the opening of the overcap and between the legs 20 to butt against the shoulder means 28 (FIGS. 4, 5). The unit so reassembled is then placed down over the container with the aperture in the washer-like element 33 receiving the central portion of the actuator 42 and engaging the shoulder 44. When the overcap is snapped into position with the nibs 22 installed over the mounting cup flange 24, the dimensions are such that the washer-like element holds the actuator 42 down causing the continuous dispensing fog. It will be clear that the dispensing shown in FIG. 5 will continue just as long as the overcap is in place and there is product in the container. When that product is exhausted, of course, the dispensing will be finished. Alternatively, the overcap may be removed to discontinue dispensing.

While the invention has been disclosed in but a limited number of forms, it is susceptible of many changes.

Thus, the invention may be defined by the following claim language including equivalents thereof:

I claim:

1. An aerosol dispensing device adapted for continuous dispensing until exhausted comprising:

(a) an aerosol container having a valve at its upper end actuateable by downward movement and having lateral projection means disposed about the valve;

(b) an inverted generally cup-shaped overcap normally installed on the container and having downward portions with nibs adapted for snap engagement with the projection means, and shoulder means on the inside of the overcap spaced below the top wall, the top wall of the overcap having an opening, and an annular portion secured within the opening by break-away means to the top wall of the overcap; and (c) actuating means adapted when the annular portion is broken away from the top wall of the overcap and placed inside the overcap against the shoulder means and the overcap is reinstalled on the container, to press down the valve so that it discharges through the opening as long as the overcap remains in place.

2. An aerosol dispensing device as claimed in claim 1 wherein the lateral projection means is an annular valve cup mounting flange.

3. An aerosol dispensing device as claimed in claim 1 wherein the valve is provided with a conventional stem and an upwardly directed actuator is snugly mounted over the stem, the actuator having an outward annular flange which is engaged by the annular portion when the overcap is reinstalled.

4. An aerosol dispensing device as claimed in claim 1 wherein the annular portion is initially formed with a removable disc which is removed prior to the reinstallation of the overcap on the container.

5. An aerosol dispensing device as claimed in claim 1 wherein the shoulder means on the overcap are provided in the lower end of a plurality of ribs extending inward from said downward portions.

6. An aerosol dispenser comprising:

(a) an aerosol container having a conventional depressible valve stem at its upper end surrounded by a valve mounting cup crimped on the can to present an outward annular projection;

(b) an actuator having an upwardly directed dispensing opening and an upwardly facing annular shoulder concentric about the opening; and (c) an overcap being of inverted cup shape and having downward leg portions thereinside, the leg portions having inward nibs for snap engagement over the outward annular projection when the overcap is installed on the container, and inward shoulders on the leg portions spaced at the same level above the nibs, the top wall of the overcap having a central opening, a washer-like element secured within the opening by break-away means to the top of the overcap, whereby the washer-like element can be broken away at the break-away means from the overcap and with the overcap removed from the container can be placed in the overcap against the shoulders and between the leg portions so that when the overcap is reinstalled on the container the washer-like element engages against the annular shoulder of the actuator and holds the valve down so that the aerosol discharges upwardly through the opening as long as the overcap is in place.

7. An aerosol dispenser as claimed in claim 6 wherein the washer-like element is initially provided with a central closing disc which may be broken away from the washer-like element.

* * * * *